US006704529B2

(12) United States Patent
Noh

(10) Patent No.: US 6,704,529 B2
(45) Date of Patent: Mar. 9, 2004

(54) IMAGE FORMING APPARATUS HAVING IMPROVED DRIVING ARRANGEMENT

(75) Inventor: Joo-Hwan Noh, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 113 days.

(21) Appl. No.: 10/072,891

(22) Filed: Feb. 12, 2002

(65) Prior Publication Data

US 2002/0114643 A1 Aug. 22, 2002

(30) Foreign Application Priority Data

Feb. 21, 2001 (KR) ..... 2001-8776

(51) Int. Cl.[7] ..... G03G 15/00
(52) U.S. Cl. ..... 399/167; 399/265
(58) Field of Search ..... 399/167, 252, 399/265, 272, 279, 281, 116, 117

(56) References Cited

U.S. PATENT DOCUMENTS 4,591,261 A * 5/1986 Saruwatari et al. ..... 399/167
5,768,656 A * 6/1998 Nagasue et al. ..... 399/75
5,839,034 A * 11/1998 Sato ..... 399/167
5,848,333 A * 12/1998 An ..... 399/167
5,950,048 A * 9/1999 Okumura et al. ..... 399/113
6,125,253 A * 9/2000 Tashima et al. ..... 399/167

FOREIGN PATENT DOCUMENTS

JP 06274023 A * 9/1994 ..... G03G/15/08
JP 08334943 A * 12/1996 ..... G03G/15/00
JP 10293464 A * 11/1998 ..... G03G/15/08

* cited by examiner

*Primary Examiner*—Robert Beatty
(74) *Attorney, Agent, or Firm*—Robert E. Bushnell, Esq.

(57) ABSTRACT

An image forming apparatus includes a power transmitting gear, which is meshed with a photosensitive drum gear and is connected to a developing roller through a belt, and an idler gear, which is provided between the power transmitting gear and a feeding roller gear, to indirectly transmit driving force from the photosensitive drum gear to the feeding roller and to the developing roller gear. Accordingly, a predetermined nip is maintained between the respective rollers, and the rollers are operated at a constant velocity.

19 Claims, 3 Drawing Sheets

IMAGE FORMING APPARATUS HAVING IMPROVED DRIVING ARRANGEMENT

CLAIM OF PRIORITY

This application makes reference to, incorporates the same herein, and claims all benefits accruing under 35 U.S.C. §119 from my application entitled DEVELOPING DEVICE OF ELECTROPHOTOGRAPHIC PRINTER filed with the Korean Industrial Property Office on the Feb. 21, 2001, and there duly assigned Ser. No. 2001-8776.

BACKGROUND OF THE INVENTION

1. Field of the Invention

The present invention relates to image formation processes and apparatus generally, and, more particularly, to developing devices and processes for electrophotographic printers, laser printers, photocopiers.

2. Description of the Related Art

Generally, an electrophotographic printer includes a developing device that transfers images from a surface of a photosensitive drum to a printable medium such as paper fed from an internal or external feed device, and a fixing roller that heats the toner forming a latent image borne by the printable medium.

Conventional electrophotographic printers use a photosensitive drum, a developing roller, and a feeding roller. There must be nips, which are contact areas, between the photosensitive drum and the developing roller, and between the developing roller and the feeding roller. To maintain these nips, the electrophotographic printer has a power transmitting gear and the timing belt. Since the developing roller and the feeding roller are directly meshed with each other, it is difficult to transmit the power at a desirable velocity ratio while maintaining their nip within an acceptable range of length.

Direct contact between the feeding roller and the developing roller induces vibration and inconsistent velocity of the feeding roller while the feeding roller is transferring the developer to the developing roller. This, in turn, causes jitter, that is, irregular gaps between dots of a latent image on the exterior cylindrical surface of the photosensitive drum, so that the best printing quality cannot be assured.

SUMMARY OF THE INVENTION

Accordingly, it is an object of the present invention to provide an improved image forming apparatus and process.

It is another object to provide an image forming apparatus having an improved arrangement of gears.

It is still another object to provide a developing device and process in an electrophotographic printer that exhibits minimal jitter.

It is yet another object to provide a developing device and process in an electrophotographic printer that reduces occurrence of vibration while maintaining constant velocity of the feeding roller.

According to the present invention, an image forming apparatus may be constructed according to the principles of the present invention with a power transmitting gear meshed with a photosensitive drum gear formed on a photosensitive drum, and a transmission belt that transmits a driving force from the power transmitting gear to a developing roller gear formed on a developing roller. The power transmitting gear is meshed with an idler gear, and the idler gear is meshed with a feeding roller gear formed on a feeding roller that feeds a developer to the developing roller. With this configuration, the power transmitting gear transfers a driving force from the photosensitive drum to the feeding roller gear.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The preferred embodiments of the present invention will now be described with reference to the accompanying drawings.

Figure 1:
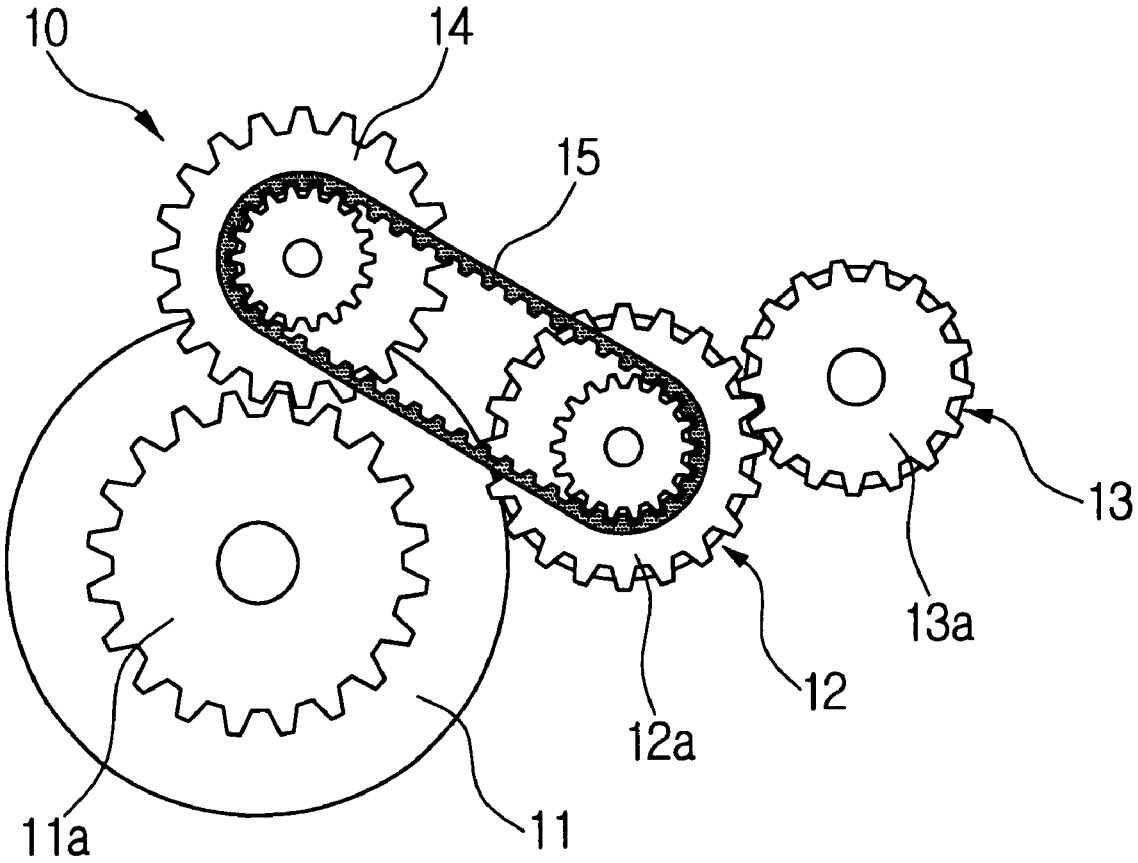
FIG. 1 is a sectional view showing the gear arrangement in the conventional image forming apparatus.

As shown in FIG. 1, the conventional image forming apparatus 10 includes a photosensitive drum 11, a developing roller 12, and a feeding roller 13.

By contact with the feeding roller 13, developer (not shown) held in a casing 10*a* is subject to static electricity. Due to the static electricity, the developer is transferred from the feeding roller 13 onto the surface of the developing roller 12. The developer attached onto the developing roller 12 is transmitted to electrostatic latent images formed on the surface of the photosensitive drum 11. A nonmagnetic toner is usually used as the developer.

In the conventional image forming apparatus, the photosensitive drum 11, the developing roller 12, and the feeding roller 13 have a photosensitive drum gear 11*a*, a developing roller gear 12*a*, and a feeding roller gear 13*a* respectively. The photosensitive drum gear 11*a* is meshed with a power transmitting gear 14 which is connected to the toothed pulley on the developing roller gear 12*a* via a timing belt 15. Driving force is transferred from a driving portion (not shown) to the photosensitive drum 11 and then to the developing roller 12 through the developing roller gear 12*a* and then to the feeding roller 13 through a feeding roller gear 13*a*.

In order for the developer T to be conveyed to the photosensitive drum 21 under a relatively constant condition, nips must be maintained constantly between the photosensitive drum 11 and the developing roller 12, and between the developing roller 12 and the feeding roller 13. To maintain these nips, the conventional image forming apparatus 10 has a power transmitting gear 14 and a timing belt 15. Since the developing roller 12 and the feeding roller 13 are directly meshed with each other, it is difficult to transmit the power at a desirable velocity ratio while maintaining their nip within an acceptable range of length.

Direct contact between the feeding roller 13 and the developing roller 12 induces vibration and inconsistent velocity of the feeding roller 13 while the feeding roller 13 is transferring the developer to the developing roller 12. This problem causes jitter, that is, irregular gaps between dots of an image of the photosensitive drum 11.

Figure 2:
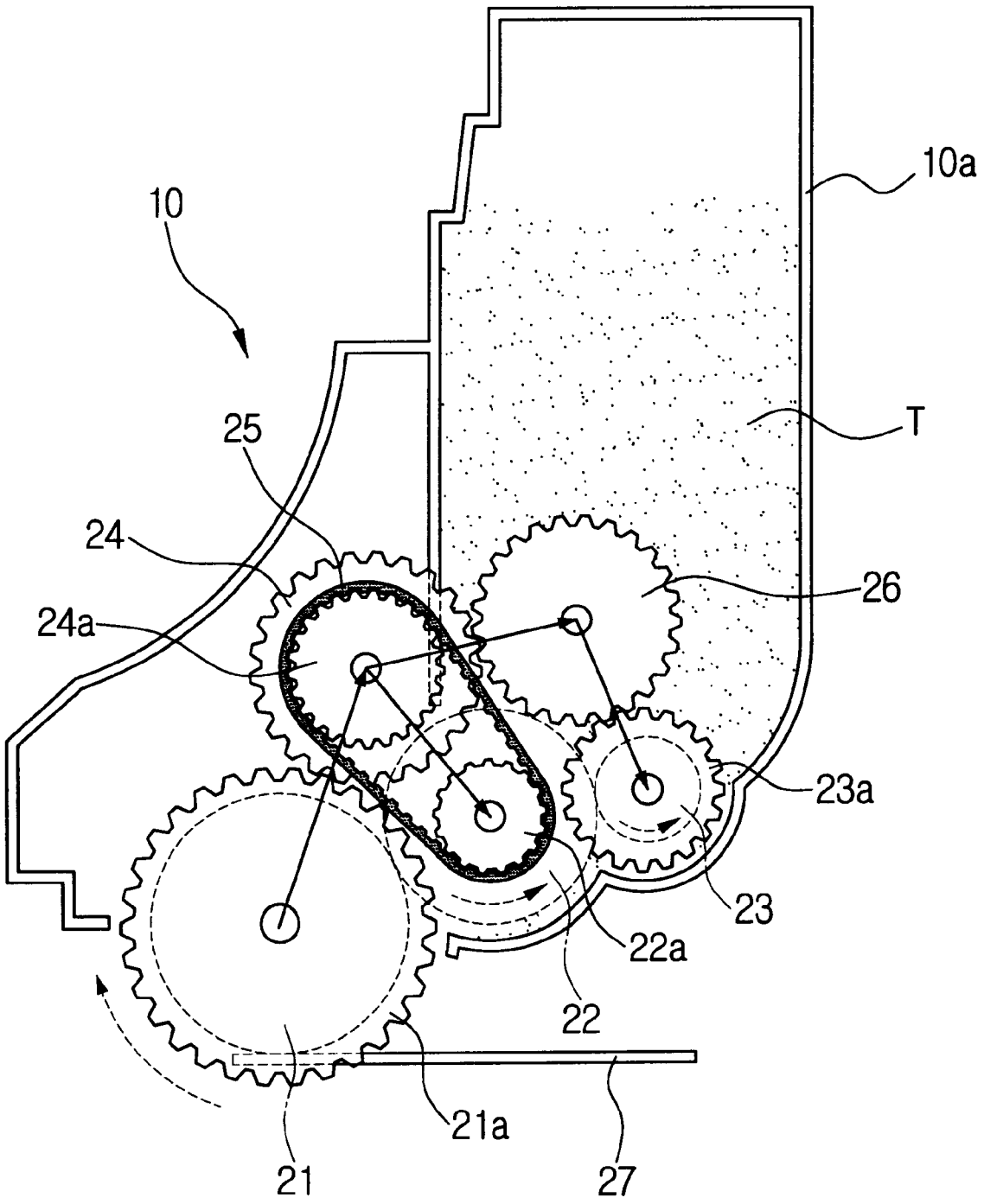
FIG. 2 is a sectional view showing [[the]] a first preferred gear arrangement in the image forming apparatus constructed according to the principles of the present invention.

Referring now to FIG. 2, an image forming apparatus 10 is provided to an electrophotographic printer to transfer a developer T onto a printable medium 27. The image forming apparatus 10 includes a photosensitive drum 21, a developing roller 22, a feeding roller 23, a power transmitting gear 24, and belt 25.

The photosensitive drum 21 formed in a casing 10*a* is rotated by a driving force transferred from a driving portion (not shown). While the electrophotographic printer is being driven, the photosensitive drum 21 is exposed by an exposing device (not shown), and a predetermined electrostatic latent image is formed on the surface of the photosensitive drum 21. The developing roller 22 transfers the developer T from the feeding roller 23 to the electrostatic latent image formed on the photosensitive drum 21. When the photosensitive drum 21, which is exposed through the image forming apparatus 10, is contacted with a printable medium 27, the developed image on the surface of the photosensitive drum 21 is transmitted to the printable medium 27.

The feeding roller 23 is rotatably installed to supply the developer T held in the casing 10*a* to the developing roller 22. The developer T is subject to static electricity due to contact with the feeding roller 23, and this static electricity makes it possible to attach the developer T onto the outer circumference of the developing roller 22 by a certain thickness.

The developing roller 22 is rotatably installed between the feeding roller 23 and the photosensitive drum 21, and transmits the developer T fed from the feeding roller 23 onto the electrostatic latent image formed on the surface of the photosensitive drum 21.

The gears are arranged in such a manner that the feeding roller gear 23*a*, the toothed pulley gear 22*a*, and the photosensitive drum gear 21*a* are disposed on each rotary shaft for the feeding roller 23, the developing roller 22, and the photosensitive drum 21. By the interaction between the respective gears, the feeding roller 23 and the developing roller 22 receive the power from the photosensitive drum 21.

The power transmitting gear 24 transfers the driving force from the photosensitive drum 21 to the developing roller 22 and the feeding roller 23. The power transmitting gear 24 is meshed with the photosensitive drum gear 21*a*. The power transmitting gear 24 includes a toothed pulley gear 24*a* for power transmission. The toothed pulley 24*a* in the power transmitting gear 24 and the toothed pulley gear 22*a* in the developing roller 22 are connected with each other via the belt 25. By connecting the power transmitting gear 24 and the developing roller 22 by the belt 25 through the toothed pulley 22*a* and toothed pulley gear 24*a*, the photosensitive drum 21 and the developing roller 22 are maintained at a predetermined constant nip and velocity ratio. It is preferable that the nip between the photosensitive drum 21 and the developing roller 22 is approximately 0.1 mm long. Here, in order to indirectly transmit the power from the photosensitive drum 21 to the developing roller 22, the belt 25 is used. By using the belt instead of using a plurality of transmitting gears, power loss by pitch error is significantly reduced because the pitch error is mainly caused by the use of a plurality of transmitting gears 24. Furthermore, the use of belt reduces vibration at the developing roller 22 and the jitter caused by the operation at inconstant velocity.

In order to connect the power transmitting gear 24 with the feeding roller gear 23*a*, more than one idler gear 26 can be meshed with all the gears. Since the developing roller 22 and the feeding roller 23 connected with each other indirectly, a constant nip is maintained between the developing roller 22 and the feeding roller 23. Also, since the vibration or inconsistent velocity in the feeding roller 23 is generated by the direct contact between the developer T held in the casing 10*a* and the feeding roller 23, the indirect connection between the developing roller 22 and the feeding roller 23 significantly reduces the transmission of the vibration or inconstant velocity from the feeding roller 23 to the developing roller 22.

Figure 3:
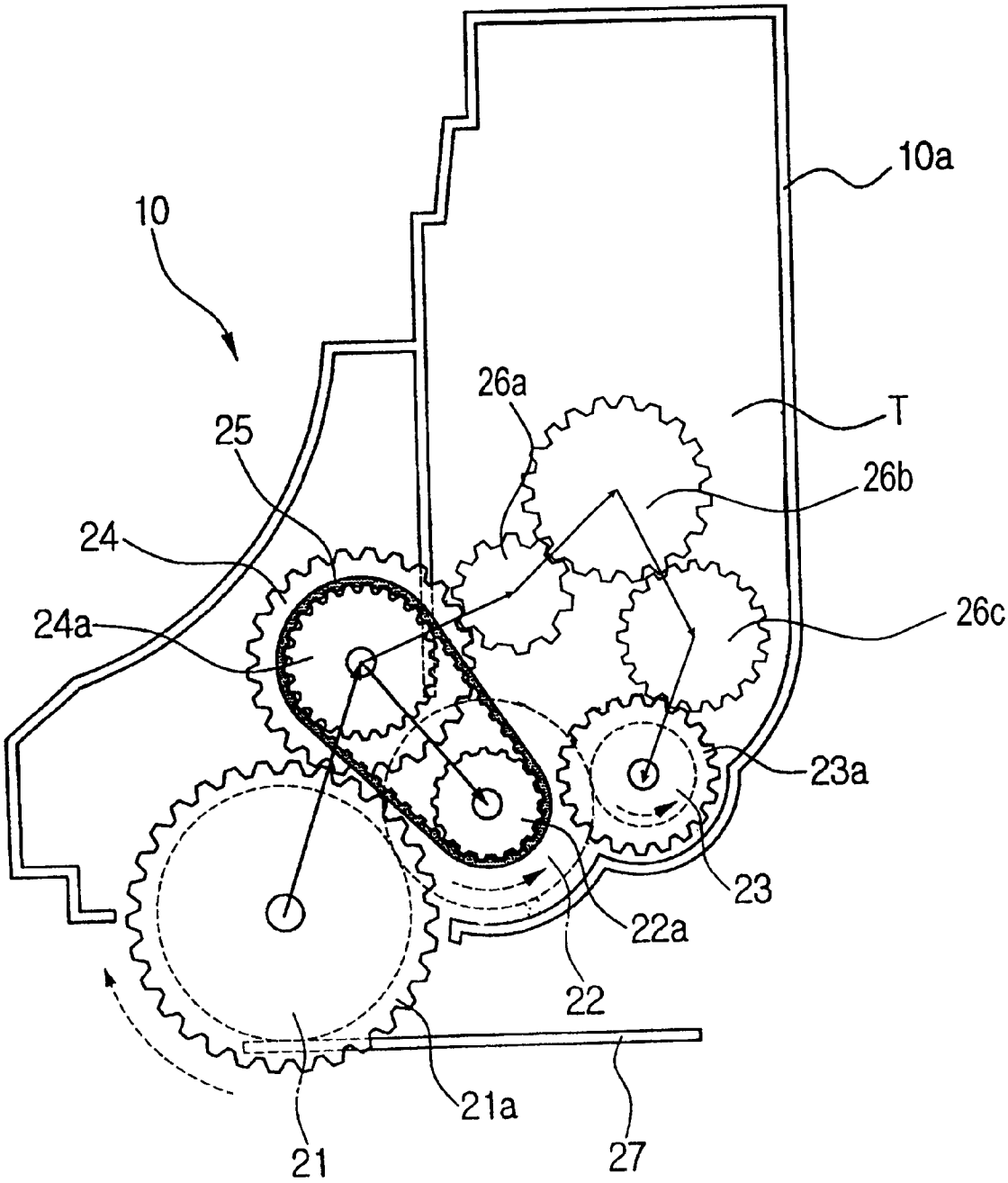
FIG. 3 is a sectional view showing a second preferred gear arrangement in the image forming apparatus constructed according to the principles of the present invention.

In transmitting the driving force to the feeding roller gear 23*a*, $2n-1$ (n=positive integer) of idler gear 26 is preferred for obtaining a uniform rotational direction of the feeding roller 23 as indicated by dot-lined arrows of FIG. 2 and FIG. 3. FIG. 2 shows a preferred embodiment having one idler gear 26. FIG. 3 shows another preferred embodiment having three idler nears 26*a*. 26*b* and 26*c*.

Further, in order to minimize the power loss due to increased number of idler gear 26 during the power transmission to the feeding roller 23, it is more preferable that one idler gear 26 is used.

In the image forming apparatus 10 constructed as above, when the electrophotographic printer is driven, the photosensitive drum 21, the developing roller 22, and the feeding roller 23 are rotated in the direction indicated by the dot-lined arrow of FIG. 2. The driving force generated from the photosensitive drum 21 is transmitted in the direction as indicated by a solid-lined arrow of FIG. 2. More specifically, after the driving force generated from the photosensitive drum 21 is transmitted to the power transmitting gear 24, the driving force is transmitted to the developing roller 22 through the belt 25. The power transmitting gear 24 also transmits the driving force to the idler gear 26 meshed therewith, thereby transmitting the driving force to the feeding roller gear 23*a* that is meshed with the idler gear 26. Accordingly, the developer T held within the casing 10*a* is conveyed to the developing roller 22 through the feeding roller 23. The developer T transferred onto the developing roller 22 is then attached onto the electrostatic latent image formed on the photosensitive drum 21, and then transferred onto the printable medium 27. Where there are three idler gears as shown in FIG. 3, a first idler gear 26*a* is meshed with the power transmitting sear 24, a second idler gear 26*b* is meshed with the first idler gear 26*a*, and a third idler near 26*c* is meshed with the second idler gear 26*b* and the feeding roller gear 23*a*.

As described above, since the driving force generated from the photosensitive drum 21 is indirectly transmitted to the developing roller 22 and the feeding roller 23, the constant nip between the developing roller 22 and the feeding roller 23 is maintained.

Furthermore, since vibration and operation at inconstant velocity generated from the developing roller 22 and the feeding roller 23 are indirectly transmitted to the photosensitive drum 21, the effect of the vibration and inconstant-velocity operation are minimized.

Thus, since the developer T is conveyed to the photosensitive drum 21 under a relatively constant condition, the printing quality improves.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. An image forming apparatus, comprising:

a photosensitive drum coaxially bearing a photosensitive drum gear;

a developing roller contacting with said photosensitive drum so as to form a first nip, said developing roller coaxially bearing a first pulley;

a feeding roller contacting with said developing roller so as to form a second nip, said feeding roller coaxially bearing a feeding roller gear and feeding a developer to the developing roller;

a power transmitting gear meshed with the photosensitive drum gear, said power transmitting gear coaxially bearing a second pulley;

an idler gear concurrently meshed with the feeding roller gear and meshed with the power transmitting gear; and a belt connecting the first pulley to the second pulley, with a driving force transmitted from the photosensitive drum gear to the power transmitting gear, from the power transmitting gear to the feeding roller gear via the idler gear, and to the developing roller through the first and second pulleys and the belt.

2. The image forming apparatus of claim 1, further comprised of said first nip being approximately 0.1 millimeter long.

3. The image forming apparatus of claim 1, further comprised of:

said first pulley and said second pulley each exhibiting an exterior circumferential surface bearing first and second pluralities of arcuately spaced-apart teeth; and said belt having an inner surface bearing a plurality of spaced-apart teeth simultaneously meshing with said first and second pluralities of teeth.

4. An image forming apparatus, comprising:

a photosensitive drum coaxially bearing a photosensitive drum gear;

a developing roller contacting with said photosensitive drum so as to form a first nip, said developing roller bearing a first pulley;

a feeding roller contacting with said developing roller so as to form a second nip, said feeding roller coaxially bearing a feeding roller gear and feeding a developer to the developing roller;

a power transmitting gear meshed with the photosensitive drum gear, said power transmitting gear coaxially bearing a second pulley;

a first idler gear meshed with the power transmitting gear;

a second idler gear meshed with the first idler gear;

a third idler gear meshed with the second idler gear and the feeding roller gear; and a belt connecting the first pulley to the second pulley, with a driving force is transmitted from the photosensitive drum gear to the power transmitting gear, from the power transmitting gear to the feeding roller gear via said first, second and third idler gears, and to the developing roller through the first and second pulleys and the belt.

5. The image forming apparatus of claim 4, further comprised of said first nip being approximately 0.1 millimeter long.

6. The image forming apparatus of claim 4, further comprised of:

said first pulley and said second pulley each exhibiting an exterior circumferential surface bearing first and second pluralities of arcuately spaced-apart teeth; and said belt having an inner surface bearing a plurality of spaced-apart teeth simultaneously meshing with said first and second pluralities of teeth.

7. An image forming apparatus, comprising:

a photosensitive drum bearing a photosensitive drum gear;

a developing roller bearing a developing roller gear;

a feeding roller bearing a feeding roller gear, feeding a developer to the developing roller;

a power transmitting gear connected to the photosensitive drum gear and connected to the developing roller gear; and an idler gear connected to the feeding roller gear and connected to the power transmitting gear, with a driving force transmitted from the photosensitive drum gear to the power transmitting gear, from the power transmitting gear to the feeding roller gear via the idler gear, and to the developing roller through the developing roller gear.

8. The image forming apparatus of claim 7, further comprised of said photosensitive drum and said developing roller maintaining a nip that is approximately 0.1 millimeter long.

9. The image forming apparatus of claim 7, further comprising:

a pulley mounted on the power transmitting gear; and a belt connecting said developing roller gear to said power transmitting gear, said belt transferring the driving force from said power transmitting gear to said developing roller gear.

10. The image forming apparatus of claim 9, further comprised of:

said pulley and said developing roller gear each exhibiting an exterior circumferential surface bearing first and second pluralities of arcuately spaced-apart teeth; and said belt having an inner surface bearing a plurality of spaced-apart teeth simultaneously meshing with said first and second pluralities of teeth.

11. The image forming apparatus of claim 7, further comprised of said developing roller gear directly meshed with the power transmitting gear.

12. The image forming apparatus of claim 7, further comprised of said idler gear directly meshed with the power transmitting gear.

13. The image forming apparatus of claim 12, further comprised of said idler gear directly meshed with the feeding roller gear.

14. A method for operating image forming apparatus in an electrophotographic printer, the method comprising:

transmitting a driving force from a source of rotational energy to a photosensitive drum gear connected to a photosensitive drum;

rotating the photosensitive drum with rotational energy transmitted from the photosensitive drum gear;

transmitting the driving force from the photosensitive drum gear to a power transmitting gear;

concurrently transmitting the driving force from the power transmitting gear to an idler gear and a developing roller gear connected to a developing roller;

rotating the developing roller with rotational energy transmitted from the developing roller gear;

transmitting the driving force from the idler gear to a feeding roller gear connected to a feeding roller; and rotating the feeding roller with rotational energy transmitted from the feeding roller gear.

15. The method of claim 14, said step of transmitting the driving force from the power transmitting gear to the developing roller gear further comprising:

transmitting the driving force from the power transmitting gear to a pulley mounted on the power transmitting gear;

transmitting the driving force from the pulley to a belt; and transmitting the driving force from the belt to the developing roller gear.

16. The method of claim 15, further comprised of maintaining synchrony between rotation of said pulley and said developing roller gear.

17. The method of claim 14, said step of transmitting the driving force from the power transmitting gear to the idler gear being performed by meshing the power transmitting gear with the idler gear.

18. The method of claim 17, said step of transmitting the driving force from the power transmitting gear to the developing roller gear further comprising:

transmitting the driving force from the power transmitting gear to a pulley mounted on the power transmitting gear;

transmitting the driving force from the pulley to a belt; and transmitting the driving force from the belt to the developing roller gear.

19. The method of claim 18, further comprised of maintaining synchrony between rotation of said pulley and said developing roller gear.

* * * * *